US006342861B1

(12) United States Patent
Packard

(10) Patent No.: US 6,342,861 B1
(45) **Date of Patent: *Jan. 29, 2002**

(54) LOOP ANTENNA ASSEMBLY

(75) Inventor: Daniel A. Packard, 8 Florence Rd., Marblehead, MA (US) 01945

(73) Assignee: Daniel A. Packard, Marblehead, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/931,902

(22) Filed: Jun. 3, 1997

Related U.S. Application Data

(63) Continuation of application No. 08/051,573, filed on Apr. 22, 1993, now abandoned, which is a continuation of application No. 07/343,862, filed on Apr. 26, 1989, now abandoned.

(51) Int. Cl.[7] ..... H01Q 1/16; H01Q 7/00

(52) U.S. Cl. ..... 343/741; 343/834

(58) Field of Search ..... 343/741, 834, 343/742; H01Q 1/16, 7/00

(56) References Cited

U.S. PATENT DOCUMENTS

| | | | | |
|---|---|---|---|---|
| 2,537,191 | A | 1/1951 | Moore | 343/742 |
| D213,375 | S | 2/1969 | Habig | D26/14 |
| 3,532,315 | A | 10/1970 | Partridge | 343/742 |
| 4,138,682 | A | 2/1979 | Doherty | 343/742 |
| 4,593,289 | A | 6/1986 | Newcomb | 343/795 |
| 4,701,764 | A | 10/1987 | Malcombe | 343/742 |

FOREIGN PATENT DOCUMENTS

| | | |
|---|---|---|
| GB | 850974 | 10/1960 |

OTHER PUBLICATIONS

Jasik, "Antenna Engineering Handbook", First Edition, 1961, pp. 5–1 to 5–18.*

Johnson et al. (Johnson), "Antenna Engineering Handbook", Second Edition, 1984, pp. 5–1, 5–2 and 5–15 to 5–18.*

Smith, "Delta Beams for 10 and 15 Meters", Practical Wireless, Mar. 1981, pp 62–64 (343/741).*

Orr & Cowan, All About Cubical Quad Anetnnas, Third Edition 1982, pp. 10–40, 89–96, 97–109.

The American Radio Relay League, The ARRL Antenna Book, 15th ed. 1988, pp. 12–7, 12–9 to 12–13.

The American Radio Relay League, The ARRL Antenna Anthology, 1978, pp. 53–59, 66–69 (Chapter 3).

The American Radio Relay League, QST, Oct. 1984, Doug DeMaw et al., pp. 24–26.

73, Inc. 73 Magazine, vol. XIV, No. 7, Jul. 1963, pp. 48, 49.

Orr & Cowan, The Radio Amateur Antenna Handbook, 1978, pp. 123–125, 156, 157, 114–115, 164, 165, 168.

(List continued on next page.)

*Primary Examiner*—Michael C. Wimer

(57) ABSTRACT

A full-wave loop antenna assembly having unique mechanical stability and electromagnetic characteristics is disclosed. The antenna assembly is suitable for use in the High frequency and Very high frequency portions of the electromagnetic spectrum and is capable of supporting multiple driven and parasitic elements in a variety of configurations for multi-band operation. The assembly includes an upper load-bearing boom and a lower boom which may be load bearing, between which at least a part of the weight loads created by the driven and parasitic elements may be distributed. The assembly may also include a parasitic element, tuned as a reflector, which is considerably longer than other parasitic reflectors which are used with antennas of this type, thereby providing the desired directional characteristics over a wider range of frequencies than are obtained by other antennas of its type.

10 Claims, 6 Drawing Sheets

OTHER PUBLICATIONS

Moxon, HF Antennas For All Locations, 1982, pp. 152, 153.
The American Radio Relay League, QST, vol. LIII, No. 1, Jan. 1969, pp. 26–32.
The American Radio Relay League, QST, vol. LI, No. 9, Sep. 1967, pp. 34–36, 142.
The American Radio Relay League, QST, vol. LII, No. 4, Apr. 1968, pp. 54.
The American Radio Relay League, QST, Mar., 1971, pp. 48.
The American Radio Relay League, QST, Jun., 1973, pp. 24–27 (A Modified 20–Meter Delta–Loop Beam) Fleming.
The American Radio Relay League, QST, May, 1975, pp. 18–21, 168, 170.
The American Radio Relay League, QST, Mar. 1983, pp. 36, 37. (The Two–Band Delta–Loop Antenna) Gray.
The American Radio Relay League, QST, Dec. 1981, pp. 32, 33. (Build this Extended, Expanded Collinear Array) Schmidt.
The American Radio Relay League, QST, Nov. 1984, pp. 48, 49. (Meet the Curtain–Quad Antenna) Anderson.
The American Radio Relay League, QST, Jan. 1975, pp. 23, 49. (A Simple Fixed–Direction Quad) Bacher.
Communications Technology, Inc., Ham Radio, vol. 1, No. 1 May 1968, pp. 53, Installation Instructions.
CQ Magazine, The Radio Amateurs Journal, Sep. 1961, pp. 46–48 (The Delta Quad) Joe Williams.
The American Radio Relay League, The ARRL Antenna Compendium, 1985, pp. 24–28 (Gossamer Quad Update) Thompson.
The American Radio Relay League, The ARRL Handbook for the Radio Amateur, 1987, pp. 17–17, 17–18.
Communications Technology, Inc., Ham Radio, May 1988, pp. 43, 44, 49, 51, 52. (The Quad Antenna: Part 1) Haviland.
Ito et.al., An Investigation of the Array of Circular–Loop Antennas, IEEE Trans. on Antennas and Prop., vol. AP–19, No. 4, Jul. 1971.

* cited by examiner

LOOP ANTENNA ASSEMBLY

This application is a continuation of application Ser. No. 08/051,573 filed on Apr. 22, 1993 now abandoned, which is a continuation of application Ser. No. 07/343,862 filed on Apr. 26, 1989 now abandoned.

BACKGROUND OF THE INVENTION

1. Field of the Invention

This invention relates generally to the field of antennas, and more particularly to loop antenna assemblies intended for use in the high frequency and very high frequency portions of the electromagnetic spectrum.

2. Discussion of the Prior Art

The full wave loop antenna is generally recognized as one of the best conventional antennae for use in the high frequency and very high frequency portions of the electromagnetic spectrum for several reasons. First, the loop configuration tends to reduce fading on both transmission and reception. In addition, the full wave loop antenna provides enhanced directivity, gain, and "capture area" in comparison to other conventional antennae. Lastly, the full wave loop antenna is a "quiet" receiving antenna and displays a reduced level of "static" interference when compared with other conventional antennae.

The two major types of full-wave loop antennae in wide use today in the high frequency and very high frequency spectrums are the "cubical quad" and the "delta quad". The cubical quad antenna is readily identified by the shape of its elements, which are generally square and vertically oriented. Similarly, the delta quad antenna may be identified by its elements, which are vertically oriented and generally in the shape of an equalateral triangle with one apex pointing toward the ground. The cubical quad normally uses support arms for the elements which join the mast at a single point, or a single boom which is fastened to the support arms, while the delta quad typically has all of the weight of the elements carried by a single boom.

Both the cubical quad and the delta quad antenna, however, display a number of disadvantageous characteristics.

First, due to the structural configuration of the antennae, they generally must be partially or completely assembled on the ground, making them quite difficult to install. For example, a typical cubical quad for the twenty meter amateur radio band has two square elements, each of which is approximately 17 feet on a side, which must be installed in a vertical orientation on a support structure such as a mast or a tower. Obviously, it is very difficult to assemble such a structure on the ground and then mount it on a support structure.

Second, the geometries of the cubical quad and delta quad make the antennae mechanically unstable, leaving them quite susceptible to dammage or destruction due to adverse weather conditions, such as high winds and snow and ice loading, when made from materials commensurate with their sizes, and light enough in weight to avoid the necessity of an oversized support structure.

Third, the cubical and delta quad antennae typically include a parasitic element (reflector), which is tuned to a resonant frequency which is two and one-half to three percent below the resonant frequency of the driven element with which it is designed to operate. Consequently, as the operating frequency of the antenna drops too far below the resonant frequency of the driven element, the parasitic element will approach self-resonance, substantially deteriorating the performance of the antenna. Also, the lengths of the sides of both the cubical quad and the delta quad elements are of equal or nearly equal length, thereby limiting the domain of reflector lengths at which co-incidence, or near co-incidence, of maximum foreward gain, maximum front-to-back ratio, and minimum VSWR (voltage standing-wave ratio) occur, both the lengths of the sides of the reflector elements and their total lengths being critical for efficient operation, the spacings between the driven element and the reflector element being adjusted to maximize the foreward gain on these antennae. The cubical quad and the delta quad are, therefore, limited to a relatively narrow range of operation frequencies below the resonant frequency of their driven elements, when using a reflector element to enhance their directional characteristics.

SUMMARY OF THE INVENTION

The present invention provides an improved full-wave loop antenna assembly having enhanced structural stability and effective directional characteristics over a wider range of frequencies than other antennas of its type. The antenna assembly is rotatable, self-supporting, may be made from commercially available materials, and is capable of supporting multiple driven and parasitic elements, in a variety of configurations, for multi-band operation. In addition, the antenna has semi-rigid element members which may be made from materials which are lighter in weight than those that would be used in the construction of "Yagi"-type antennae designed for use on the same frequency or frequencies, and can be installed by a single individual in much the same fashion as a "Yagi" type antenna.

In brief summary, the antenna assembly includes two essentially horizontal booms which are attached to an essentially vertical support structure. Conductive members, each of which forms a portion of either a driven or parasitic loop antenna element are attached to, and insulated from, the lower boom. A length of wire is attached to each member, near each end. A draw line, made of flexible insulating material, is fastened to each wire at, or nearly at, its center, fed through a bore in the upper boom, and through an eyelet mounted near the junction of the upper boom and the support structure for the booms, and run down next to the support structure to the lower boom, where it may be secured. Holding the draw lines in tension creates the desired geometric shape of the antenna elements.

Due to the configuration of the antenna assembly, the upper boom must always carry at least part of the weight of the antenna elements, as there is always some contact between the draw lines fastened to the wire portions of the largest antenna element installed on the structure and the upper boom, or some component which is fastened to the upper boom. For this reason, the upper boom will be referred to as the "load-bearing upper boom." If sufficient tension is supplied to the aforementioned draw lines, all of the weight of the antenna elements may be removed from the lower boom. Releasing part of the tension on the draw lines allows part of the weight of the antenna elements to be carried by the lower boom, while still maintaining the desired geometric shape of the loop elements. Thus, the lower boom may, or may not be load-bearing for any particular loop element or group of loop elements, depending on the tension in the draw lines, the geometric configuration of the loop or loops, and the type of materials used for the loop element or elements. For this reason, the lower boom will be referred to as simply the "lower boom", although, with the exception of the test run on the embodiment depicted in FIG. 6, the lower boom was load-bearing in all embodiments disclosed.

The combination of each wire with its associated conductive member represents a loop-type driven or parasitic antenna element. Additional driven or parasitic elements may be added, and located either concentrically with other elements, or at different positions along the booms. In addition, a parasitic (reflector) element having a physical length substantially greater than those used by conventional loop parasitic reflector elements may be used to increase the effective operating bandwidth of the antenna, the optimum reflector length being a function of the separation (spacing) between the driven element and its associated parasitic reflector, a property not present in other full-wave loop antennas of this type. On all embodiments tested, the loop antenna elements were approximately one full wavelength in length at the frequencies being tested. No lumped circuit components, such as inductors or capacitors, or any other devices, were employed to electrically alter the lengths of the antenna elements. For brevity, the antenna elements will be referred to in this disclosure as simply the "driven element" and the "parasitic element", it being understood that all the antenna elements described in this disclosure are loop elements which are approximately one full electrical and physical wavelength in length at the frequencies being tested.

Tests run on all parasitic embodiments disclosed indicated an estimated foreward gain of approximately 5–8 db or higher, a front-to-back ratio of approximately 10–25 db or higher, and a front-to-side ratio of approximately 20–45 db or higher. The VSWR bandwidths of 2/1 or lower measured approximately 350 khz. or more on all embodiments disclosed, the antennas using a separate transmission line connected to the driven element indicating a considerably wider VSWR bandwidth of 2/1 or lower in most embodiments. The above and all references to "db" refers to decibles in relation to a theoretical isotropic source. The antennas disclosed where mounted above a rooftop, with the lower boom at an elevation of approximately thirty-five feet.

BRIEF DESCRIPTION OF THE DRAWINGS

The above and further advantages of the invention may be better understood by referring to the following descriptions when considered in connection with the following drawings, in which.

DETAILED DESCRIPTION OF THE ILLUSTRATIVE EMBODIMENTS

Figure 1:
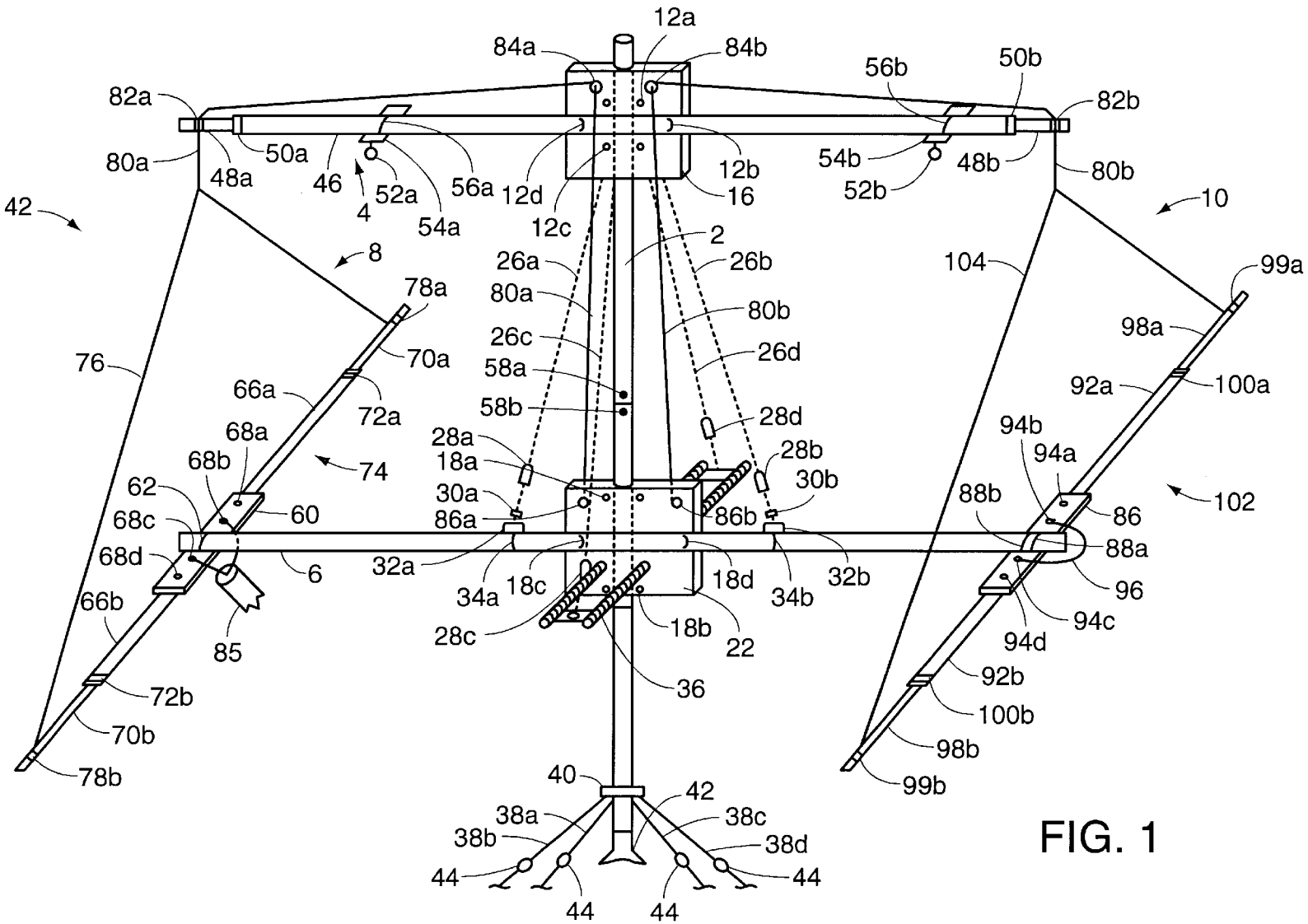
FIG. 1 is a perspective view of an antenna assembly designed for use on a single frequency band, constructed in accordance with the preferred embodiment of the present invention.

In the following detailed descriptions of the illustrative embodiments, for enhanced clarity, certain components, such as "U" bolts, saddle brackets, eyelets, unused draw lines, etc., will not be shown. For simplicity and clarity, certain components shown in more than one drawing will be designated with the same reference numerals.

FIG. 1 shows a novel antenna assembly 42 which comprises a mast 2, a load-bearing upper boom 4, a lower boom 6, a triangular-shaped driven element 8, and a triangular-shaped parasitic element 10. The load-bearing upper boom 4 is attached to the mast 2 by means of four "U" bolts 12*a,* 12*b,* 12*c,* and 12*d,* and four saddle brackets (not shown), which are used to secure them to a metal plate 16. Similarly, the lower boom 6 is attached to the mast 2 by means of four "U" bolts 18*a,* 18*b,* 18*c,* and 18*d,* and four saddle brackets (not shown), used to secure them to a metal plate 22. The metal plate 16 contains four eyelets (not shown) to which four guy wires 26*a,* 26*b,* 26*c,* and 26*d,* shown in phantom, are fastened. Two of the guy wires, 26*a* and 26*b,* are fastened to two turnbuckles 28*a* and 28*b* respectively, which are in turn fastened to eyelets 30*a* and 30*b* respectively, which are mounted on two saddle brackets 32*a* and 32*b* respectively, which are secured to the lower boom 6 by means of two "U" bolts 34*a* and 34*b* respectively. The outer two guy wires, 26*c* and 26*d* are fastened to two turnbuckles 28*c* and 28*d* respectively, which in turn are fastened to opposite ends of a strut 36, which is mounted on metal plate 22, and surrounds the mast 2. Four lower guy wires, 38*a,* 38*b,* 38*c,* and 38*d,* are attached to a "floating" guy ring 40, which is mounted on the mast 2 blow the lower boom 6. The "floating" guy ring 40 allows the mast 2 to rotate freely so that a conventional antenna rotator 42 (partially shown) may be attached to the mast 2 blow the "floating" guy ring 40 to rotate the entire antenna assembly 42. Insulators 44 are used to break up the electrical continuity of the lower guy wires 38*a,* 38*b,* 38*c,* and 38*d* in various places to prevent their resonance on any frequency intended for use by the antenna system installed on the structure.

The upper load-bearing boom 4 includes an outer sleeve 46 from which inner sleeves 48*a* and 48*b* extend. The inner sleeves 48*a* and 48*b* are held in place by means of two hose clamps 50*a* and 50*b* respectively. Two eyelets 52*a* and 52*b* are secured to two saddle brackets 54*a* and 54*b* respectively, which are secured to the upper boom 4 by two "U" bolts 56*a* and 56*b* respectively.

The mast 2 is in two sections, the upper portion fitting over an inner sleeve which is part of the lower section of the mast 2. Two nut-and-bolt assemblies 58*a* and 58*b* secure the two sections together.

The semi-rigid portion of the driven element 8 includes an insulating plate 60 which is secured to the lower boom 6 by means of a "U" bolt 62 and a saddle bracket (not shown). Attached to the insulating plate 60 are two outer sleeves 66*a* and 66*b* by means of four nut-and-bolt assemblies 68*a,* 68*b,* 68*c* and 68*d* respectively. The outer sleeves 66*a* and 66*b* are separated from each other and do not make physical or electrical contact with each other. Two telescopic inner sleeves 70*a* and 70*b* are secured in the outboard ends of outer sleeves 66*a* and 66*b* respectively by means of two hose clamps 72*a* and 72*b* respectively. Outer sleeves 66*a* and 66*b,* in combination with inner sleeves 70*a* and 70*b* respectively, are refered to in this description as driven element member 74.

The ends of a length of wire 76 are attached to and electrically connected to inner sleeves 70*a* and 70*b* respectively by means of two hose clamps 78*a* and 78*b* respectively. A non-conductive draw line 80*a* is attached to the wire 76 and fed upward through a bore 82*a* in inner sleeve

48*a*. The draw line 80*a* is fed through an eyelet 84*a* which is mounted on metal plate 16, and runs down along the mast 2 where it is secured to an eyelet 86*a* which is mounted on metal plate 22. The wire 76 and the driven element member 74 comprise the driven element 8.

The parasitic element 10 includes an insulating plate 80 which is secured to the lower boom 6 by means of two "U" bolts 88*a* and 88*b* and two saddle brackets (not shown) respectively. Outer sleeves 92*a* and 92*b* are secured to insulating plate 86 by means of four nut-and-bolt assemblies 94*a,* 94*b,* 94*c,* and 94*d.* The inboard ends of outer sleeves 92*a* and 92*b* are spaced apart such that they are not in physical or electrical contact with each other. The ends of a single wire 96 are attached to nut-and-bolt assemblies 94*b* and 94*c* respectively, electrically connecting outer sleeves 92*a* and 92*b.* Telescopic inner sleeves 98*a* and 98*b* are secured in the outboard ends of outer sleeves 92*a* and 92*b* respectively by means of two hose clamps 100*a* and 100*b* respectively. Outer sleeves 92*a* and 92*b,* in combination with inner sleeves 98*a* and 98*b* respectively, and the single wire 96 are refered to in this description as parasitic element member 102. The ends of a single piece of wire 104 are attached to and electrically connected to inner sleeves 98*a* and 98*b* respectively, by means of two hose clamps 99*a* and 99*b* respectively. A non-conductive draw line 80*b* is attached to the wire 104 and fed upwards through a bore 82*b* in inner sleeve 48*b.* The draw line 80*b* is fed through an eyelet 84*b,* which is mounted on metal plate 16, and runs down along the mast 2 where it is secured to an eyelet 86*b* which is mounted on metal plate 22. The wire 104 and the parasitic element member 102 comprise the parasitic element 10.

Two draw lines 106*a* and 106*b,* (not shown in FIG. 1) are fed through two eyelets 52*a* and 52*b* respectively. The draw lines 106*a* and 106*b* are then fed through the two eyelets 84*a* and 84*b* respectively which are mounted on metal plate 16, and run down along the mast 2 and secured to eyelets 86*a* and 86*b* respectively. The other ends of the draw lines 106*a* and 106*b* are secured to the lower boom 6. One end of an additional draw line 106*c* (not shown in FIG. 1) is secured to eyelet 86*b,* runs upward along the mast 2, through eyelet 84*b,* and then back down along the mast 2, where the other end is secured to eyelet 86*b.* The draw lines 106*a,* 106*b,* and 106*c* are not used in this embodiment of the invention.

As shown in FIG. 1, the novel antenna assembly of the present invention operates to distribute the weight of the driven and parasitic elements 8 and 10 respectively, among the load-bearing upper boom 4, the lower boom 6, and the tension in the draw lines 80*a* and 80*b* respectively running between the top of bores 82*a* and 82*b* respectively and the eyelets 86*a* and 86*b* respectively. The tension in the draw lines 80*a* and 80*b* which is transfered to the wires 76 and 104 respectively, tends to reduce any significant downward movement of the driven and parasitic element members 74 and 102 respectively, as well as the lower boom 6, such as would be caused by ice and snow loading. The use of draw lines 80*a* and 80*b,* as well as the wires 76 and 104 respectively, provide a certain measure of flexibility and resiliancy to the driven element 8 and the parasitic element 10, partially accounting for the durability of this antenna assembly. Also, as the driven and parasitic element members 74 and 102 respectively are moved laterally by the wind, their ends are pulled upwards by the wire portions 76 and 104 of the driven, and parasitic elements 8 and 10 respectively, thereby reducing the liklihood of structural failure of the driven and parasitic element members 74 and 102 respectively.

Most of the aforementioned advantages could also be achieved by securing draw lines 80*a* and 80*b* to the inner sleeves 48*a* and 48*b* respectively.

Some or all of the advantages of this novel support arrangement may be obtained, even though booms or elements having different orientations or shapes are used, so long as the booms are arranged in a particular way with respect to the elements. More specifically, since any given loop element, (whether driven or parasitic) represents some particular closed geometric shape, or some nearly closed geometric shape which may be closed by the shortest geometric means possible, which has a centroid, it is possible to locate the booms at different elevations on the support structure in such a way that the centroid of the loop element or elements lies at an elevation which falls between the elevation of the junction of the upper load-bearing boom and the support structure and the elevation of the junction of the lower boom and the support structure on which the booms are mounted, in such a way that at least part of the weight load created by the loop element or elements may be distributed between the upper load-bearing boom and the lower boom, while maintaining the desired geometric configuration of the loop element or elements. (Obviously, the driven element member 74 and the parasitic element member 102 may be mounted above or below the lower boom 6.) This characteristic may be seen in the embodiment depicted in FIG. 1, where the centroids of the loops lie at an elevation which lies between the elevation of the junction of the upper load-bearing boom 4 and the mast 2, and the junction of the lower boom 6 and the mast 2, and at least part of the weight of the loop elements 8 and 10 respectively may be distributed between the upper load-bearing boom 4 and the lower boom 6, while maintaining the desired geometric configuration of the loop driven element 8 and the loop parasitic element 10. Also, as may be seen in FIG. 1, and in all subsequent embodiments disclosed, the support structure for the booms does not lie in, or intersect, any plane substantially contained by any loop element, nor does it directly support any loop element. As may be sen in FIG. 1, each loop is contacted twice, at some distance from the support structure for the booms, at essentially two different elevations, for the maintenance of its geometric shape, support, and stability, each loop having a semi-rigid member comprising one side of the loop. The center of gravity of each loop element lies not only below a point which falls halfway between the uppermost extension of the loop element and the lowermost extension of the loop element, but considerably below the centroid of the loop element, a condition which is created by the weights of the driven element member 74 and the parasitic element member 102 respectively.

An antenna assembly, similar to the one depicted in FIG. 1, was constructed and tested. It should be understood that the specific dimensions and test results discussed below are representative of one particular embodiment of the present invention, but should not be constructed to limit or restrict the true scope of the invention. In addition, as one having ordinary skill in the art will recognize, the VSWR readings and observed directional characteristics of most antennae will vary somewhat in response to changes in a number of different factors, including the height of the antenna above ground (electrical), the proximity of surrounding objects, the method of matching or coupling (or connecting) the antenna to its transmission line, etc. It is also important to note that at the frequencies being tested, a considerable number of factors, such as the conditions of propogation, the polarization of the signals, the incident angle of the incoming or transmitted signal, the polarization of other antennas being used for testing or comparison, will affect the readings and measurements being taken, such that a significant number of tests under varying conditions of propagation are necessary to determine with a reasonable degree of accuracy the true performance of the antenna being tested.

The antenna assembly which was constructed and tested included an upper load-bearing boom that was approximately 13 feet 6 inches long, including the inner sleeve, and was constructed from a re-enforced one inch aluminum tube. The inner sleeves, made of wooden dowels, were initially intended to prevent electromagnetic coupling between the antenna element wires and the load-bearing upper boom, but subsequent testing on other embodiments has shown the wooden dowels to be unnecessary on all embodiments tested. The lower boom which was load-bearing in the above and, with the exception of the test run on the embodiment disclosed in connection with FIG. 6, in all embodiments disclosed, was approximately 13 feet 6 inches long, and was constructed from a one and one-quarter inch, 16 gage, steel tube. The driven and parasitic elements were separated apart by a distance of approximately 12 feet 11 inches, as measured along the lower boom.

The upper load-bearing boom and the lower boom were spaced apart on the support structure by a vertical distance of approximately 11 feet 11 inches (center to center). This particular distance was chosen as a result of the particular structural materials on hand or readily available, and as a conscious effort to avoid any lengths between the loop elements, either for the mast or for the upper guy wires, which would represent a one-quarter wavelength on any of the frequencies contemplated being tested. The mast was in two sections. The upper portion of the mast, approximately 7 feet 10 inches long to the upper load-bearing boom, was constructed from one and one-quarter inch aluminum tubing, fit over a sleeve on the lower portion of the mast, which was constructed from a one and one-quarter inch 16 gage steel tube, re-enforced on the inside with a one-inch steel pipe, extending from the bottom of the mast to just above the junction of the lower boom and the mast. The aluminum portion of the mast was used to reduce the weight in the upper portion of the mast, but since the aluminum was not of the structural variety, guying for the upper mast was deemed necessary. As will be obvious to one skilled in the art, the use of suitable materials for the mast, (e.g. 60-61 T6 structural aluminum tubing of suitable diameter and wall thickness) will make the use of the upper guy wires and the internal re-enforcement of the mast unnecessary for the above and greater separations between the upper load-bearing boom and the lower boom, as this is regularly done in the "stacking" of large antenna arrays. Also, suitable structural material (60-61 T6 aluminum, e.g.) can be used for the upper load-bearing boom and the lower boom as well.

The upper guy wires 38*a,* 38*b,* 38*c,* and 38*d* were used in this installation for stability of the antenna assembly's base support, since the entire assembly was mounted on a chimney, using five chimney mounting brackets. A suitable mounting base for the antenna assembly would make this unnecessary.

The use of two "U" bolts and saddle brackets to secure the insulating plate 86 to the lower boom 6 was done to ensure the stability of the junction between the parasitic element member 102 and the lower boom 6. Obviously, only one "U" bolt and saddle bracket are needed for this junction, since a single "U" bolt saddle bracket were successfully used to fasten the insulating plate 60 to the lower boom 6 in securing the driven element member 74 to the lower boom 6.

The insulating plates 60 and 86 were constructed from bakelite composition material. They were used as a convenience in coupling the transmission line 85 to the driven element 8, and for convenience in making various adjustments to the length of the parasitic element 10. This could easily be done by varying the length of the wire 96 which was electrically connected between the outer sleeves 92*a* and 92*b*. In the embodiment depicted in FIG. 1, the parasitic element member 10 was intentionally electrically connected to the lower boom 6 as a test, with no noticable changes in the performance of the antenna. As will be obvious to one skilled in the art, the driven element 8 may also be electrically connected to the lower boom 6, and a variety of different techniques, (a gamma match, e.g.) may be successfully used to couple the transmission line to the driven element 8.

The outer and inner sleeves on the driven and parasitic element members 74 and 102 were made of ⅞ inch and ¾ inch, 0.058 inch wall 60-61 T6 structural aluminum tubing respectively. This is a conductive material standardly used in "Yagi" type antenna built for the frequencies tested. The metal plates 16 and 22 were made of ⅛ inch aluminum. The strut 36 was made from two, one-half inch threaded steel rods, each 36 inches long, joined near their ends with two steel plates which were secured by four sets of two nuts, threaded onto the steel rods. The wires 76 and 104 were made of stranded aluminum guy wire. The flexible insulating material called "draw lines" in the above and all embodiments was made of nylon string. The nut-and-bolt assemblies, 68*a,* 68*b,* 68*c,* 68*d,* 88*a,* 88*b,* 88*c,* and 88*d,* as well as all nut-and-bolt assemblies used on this and all other embodiments were made of brass or stainless steel.

It is well known in the art that the length of the electrical conductor or conductors comprising an antenna element operating at high frequencies substantially determines the resonant frequency of the antenna element, the relationship between element length and resonant frequency being essentially linear. Accordingly, the lengths of the driven and parasitic element loops in the above and all other embodiments disclosed were adjusted for maximum co-incidence of minimum VSWR (voltage standing wave ratio), maximum estimated foreward gain, maximum front-to-back ratio, and maximum front-to-side ratio. This shall be referred to in this disclosure as "optimum" tuning for the antenna or antennas under discussion. When turned to optimum tuning, the driven element member 74 was approximately 30 feet 6 inches long. The wire 76 was approximately 39 feet 8 inches long. When combined with the division in the coaxial cable connected to nut-and-bolt assemblies 68*b* and 68*c* respectively, the total length of the loop driven element 8 was approximately 70 feet 4 inches.

The parasitic element member 102 was approximately 35 feet long, including the wire 96. The wire 104 was approximately 42 feet long, making the total length of the loop parasitic element 10, used as a reflector, approximately 77 feet long. A ¼ electrical wavelength of 70 ohm coaxial cable 85 was used as an impedence matching device between the driven element 74 and the 50 ohm coaxial cable which was coupled (connected) to the two-way radio equipment used for testing this and all embodiments listed in this disclosure. As will be obvious to one skilled in the art, other types of transmission lines, ballanced or unballanced, can be used successfully with the above and all other embodiments disclosed. The VSWR at the center (resonant) frequency of the antenna measured approximately 1.1/1 at 14.2 MHz. Extrapolations from measurements taken at various frequencies in the 20 meter amateur radio band indicated a projected bandwidth of more than 800 khz., having a VSWR of 2/1 or lower. Tests run on the antenna indicated an estimated foreward gain of approximately 5–8 db or higher, a front-to-back ratio of approximately 15–25 db or higher, and a front-to-side ratio of approximately 20–45 db or higher. Decreasing the spacing between the the driven element 8 and the parasitic element 10, without changing the lengths of the antenna elements, from approximately 12 feet 11 inches to approximately 8 feet, yielded a broader foreward gain pattern, and a somewhat increased front-to-back ratio. Later tests indicate that this was the result of the reflector being too long for optimum performance at that spacing.

The total length of the driven element 8 was approximately one full wavelength at 14.2 Mhz. The reflector element 10 was measured to be approximately 9.4 percent longer than the length of the driven element 8. This is in sharp contrast to conventional parasitic reflectors used on antennas of this type, which are typically two and one-half to three percent longer than the driven element with which they are designed to operate.

The optimum length of the reflector element was determined by the use of a remotely-controlled, motor driven, reversable stub shorting bar, substituted for wire 46, and allowing for continuous variance in the length of the reflector element while running tests in position at the radio equipment. This device was designed and constructed because of the great difficulty encountered in achieving any appreciable directivity for the antenna through numerous adjustments in the reflector length corresponding to the reflector length having its proper adjustment length approximately two and one-half to three percent longer than the length of the driven element, which is the length that typically corresponds to the optimum reflector length for antennas of this type. In addition, when the difference between the reflector length and that of the driven element was varied between approximately 7 and 11 percent, by varying the reflector length, very little deviation from optimum performance was noted, indicating that the reflector length in the antenna is not nearly as critical as those used in conventional antennas of this type. This feature was also confirmed by measurements taken over a wide range of frequencies on both transmitted and received signals on other embodiments of the present invention using additional frequency bands, and partially accounts for the improved directional characteristics over a wider range of frequencies than those achieved by conventional antennas of this type.

Obviously, other proportions of the particular geometric shape used, as well as other geometric shapes, such as squares, rectangles, trapezoids, or other symetrical or non-symetrical shapes, may be chosen to meet the desired structural and operational parameters of the antenna, and this and the subsequent embodiments of the present invention are offered merely as examples of the present invention. Also, the unique operational parameters disclosed may be utilized by installing the desired antenna elements on a variety of structures, rotatable and non-rotatable, such as fixed supporting members, using a variety of conductive materials for the antenna elements.

The above and all embodiments disclosed were tested at various transmitting power levels, ranging from less than 100 watts PEP to greater than 1000 watts PEP, with no adverse effects at the higher power levels.

As will be obvious to one skilled in the art, various techniques, such as the use of inductances, capacitances, coupling stubs, etc., may be used to electrically alter the lengths and dimensions of the antenna elements. Also, the loops may be physically or electrically open, by the use of "traps", e.g., to allow for operation on different or multiple frequency bands. Other devices, such as a balun transformer, may be used in place of the ¼ wave matching section of 70 ohm coaxial cable used in the above and other embodiments disclosed.

The embodiment of the antenna assembly disclosed above, as well as the other embodiments disclosed may be installed by a single individual positioned in one location, such as on a rooftop or the top of an antenna tower according to the following procedure. First, the upper load-bearing boom 4 is attached to the mast 2. The various draw lines are installed in their proper bores and eyelets, and both ends of all draw lines are temporarily secured at a point on the mast 2 near its bottom end. The upper guy wires 26*a,* 26*b,* 26*c,* and 26*d* are secured to their respective eyelets on the metal plate 16, and temporarily secured to the mast 2 near its bottom end. The assembly is raised and installed in the base support for the antenna assembly.

The metal plate 22 is installed on the mast 2, and upper guys 26*c* and 26*d* are secured to the strut 36. The lower boom 6 is fed through "U" bolts 18*c* and 18*d,* which are not tightened. The lower boom 6 may then be slid back and forth to allow for installation of the driven element 8 and the coaxial cable 85 on the lower boom 6. The draw line 80*a* is fastened to wire 76 and the lower boom is slid over to allow for the installation of the parasitic element 10. Draw line 80*b* is fastened to wire 104, and the lower boom is slid to its desired operating position and secured. Eyelets 28*a* and 28*b* are installed on the lower boom 6, each about 18 inches from the mast 2, and upper guy lines 26*a* and 26*b* are secured to eyelets 28*a* and 28*b* respectively. The draw lines 80*a* and 80*b* are put in tension and secured. Thus, in addition to providing tension for maintaining the elements in their desired geometric configuration, draw lines 80*a* and 80*b,* as well as the other draw lines used on the other embodiments disclosed, aid significantly in the installation of the antenna assembly. Obviously, other means, such as pulleys, can be used to raise and lower the wires 76 and 104, as well as the wire portions of the other embodiments disclosed.

To further examine the potential of the antenna system, several other embodiments of the present invention were constructed and tested. In the embodiment depicted in FIG. 2, 125, for clarity certain components (e.g. "U" bolts, saddle brackets) are omitted from FIG. 2, and shown in the enlarged views of the composite antenna elements in FIG. 3 and FIG. 4. Other components are shown in phantom.

Figure 2:
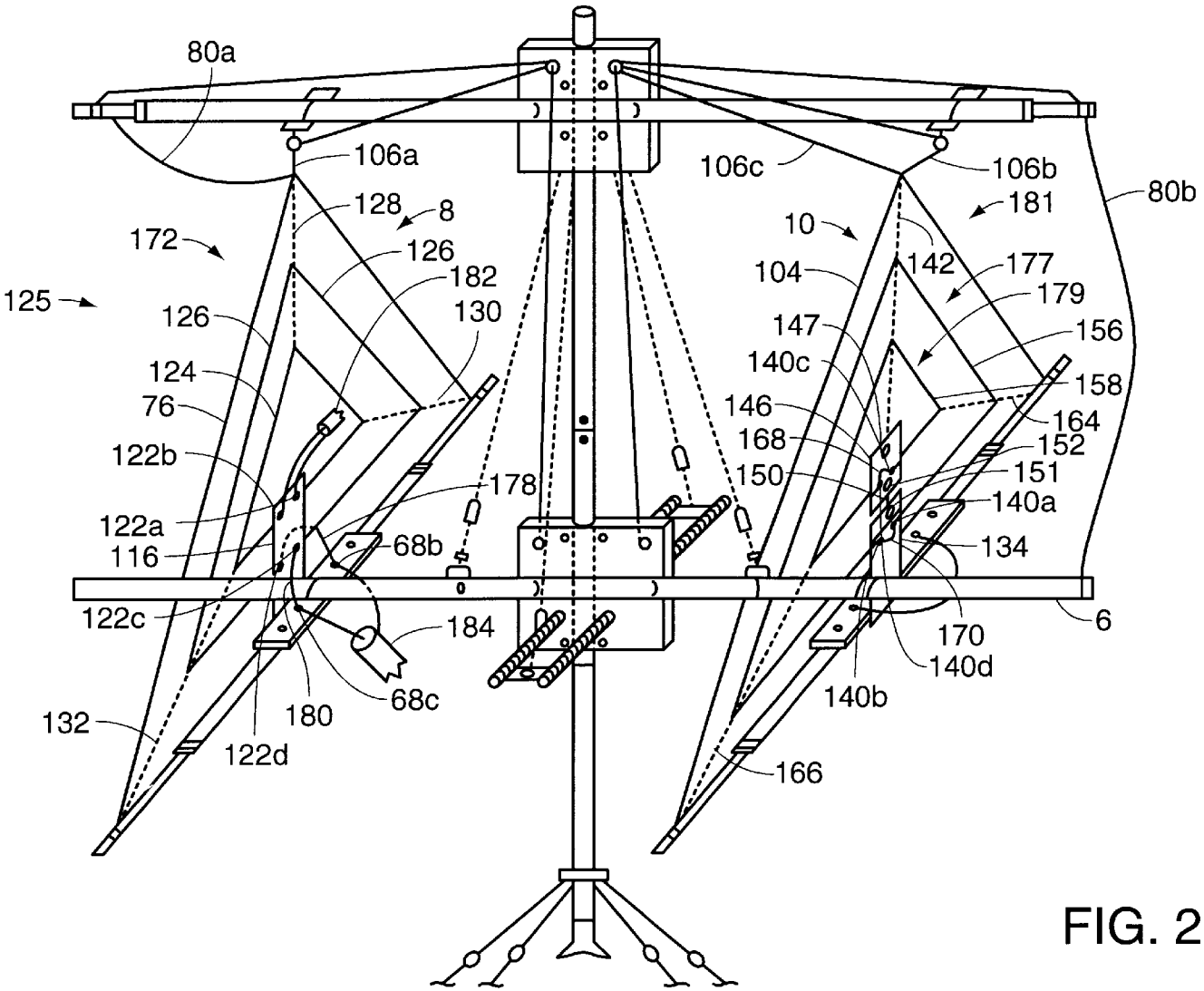
FIG. 2 is a perspective view of an antenna assembly designed for use on three separate frequency bands.
Figure 3:
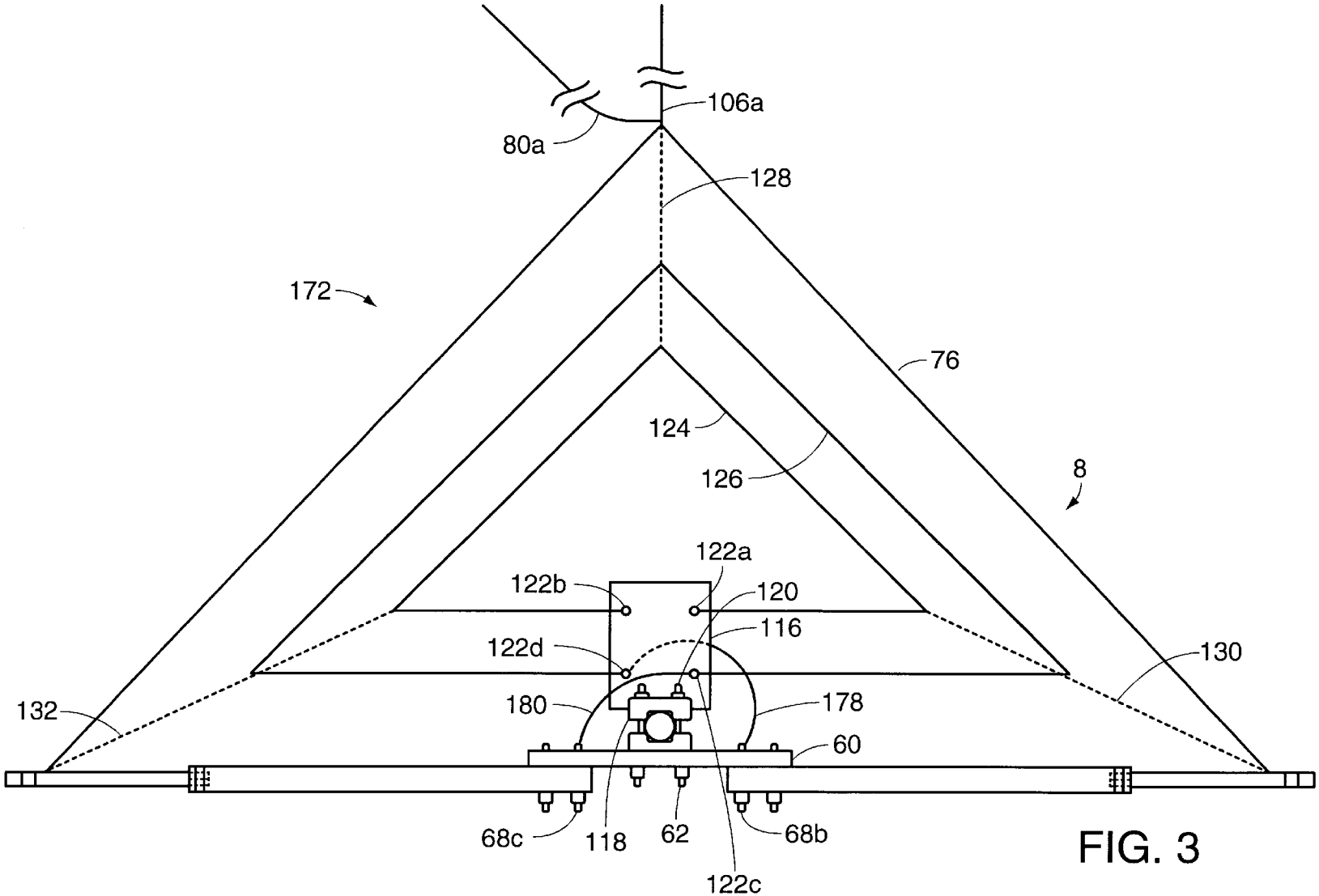
FIG. 3 is an enlarged view of the driven element portion of the antenna assembly shown in FIG. 2.

In the embodiment depicted in FIG. 2, two additional wire antenna driven elements 124 and 126 respectively, were suspended inside the driven element 8 depicted in FIG. 1, and two additional wire parasitic elements, 177 and 179 respectively, were suspended inside the parasitic element 10 depicted in FIG. 1, all wires being disposed essentially concentrically.

Referring to FIG. 2, an insulating plate 116, was mounted on lower boom 6 by fastening it to a saddle bracket (118 of FIG. 3) which was secured to lower boom 6 with a "U" bolt (120 FIG. 3). four nut-and-bolt assemblies 122*a,* 122*b,* 122*c,* and 122*d* were installed on the insulating plate 116. The ends of a separate driven element wire 124 were secured to nut-and-bolt assemblies 122*a* and 122*b* respectively. The ends of a separate driven element wire 120 were secured to nut-and-bolt assemblies 122*c* and 122*d* respectively. Three lengths of flexible insulating line, 128, 130, and 132 respectively, were used to fasten each of the three corners of wire driven elements 124 and 126 respectively to the three corners of the driven element 8. The driven element wires 124 and 126 comprise the driven elements 124 and 126 respectively. Driven elements 8, 124, and 126 comprise composite driven element 172.

Figure 4:
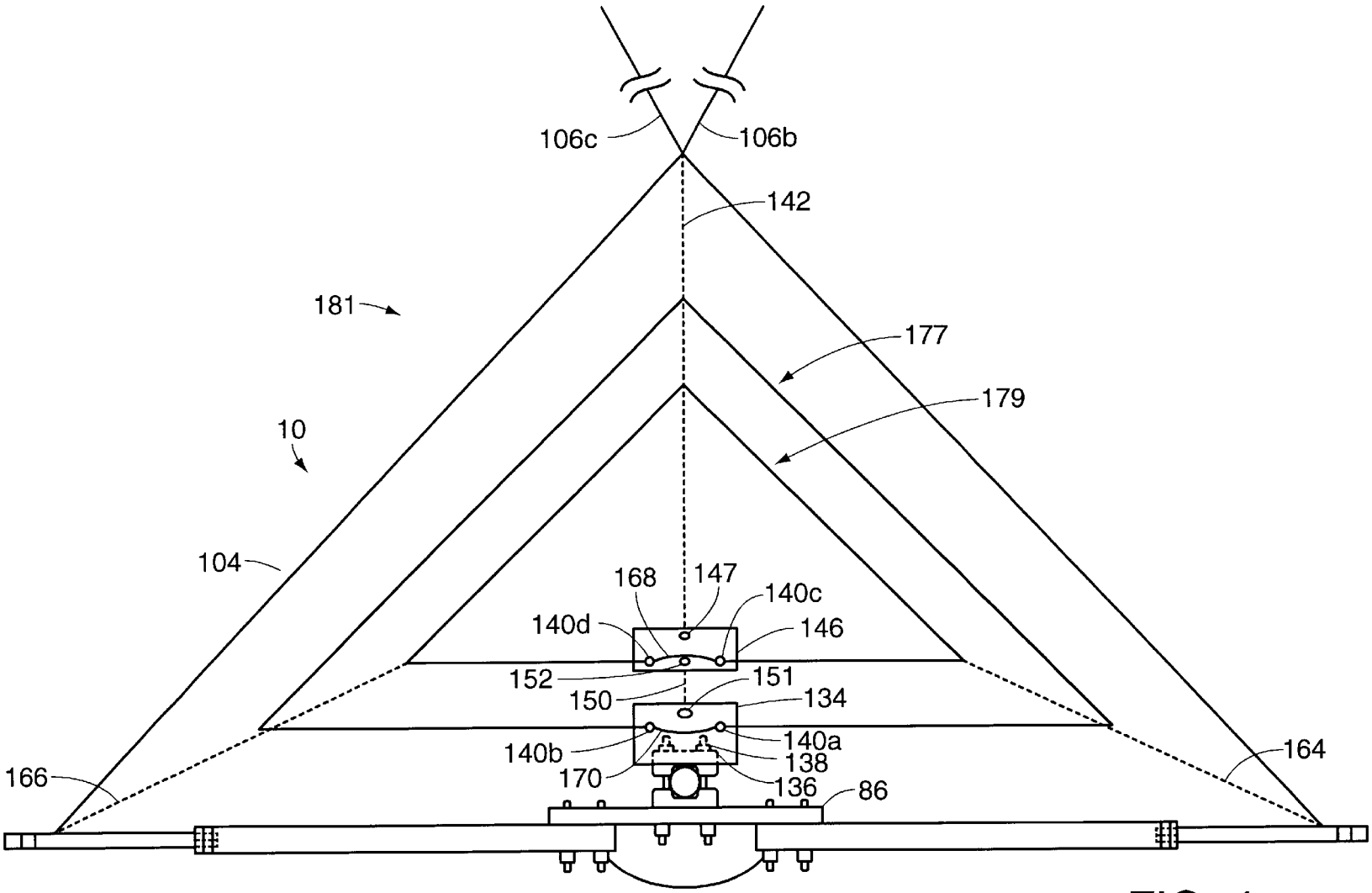
FIG. 4 is an enlarged view of the parasitic element portion of the antenna assembly shown in FIG. 2.

In the same fashion, insulating plate 134 was installed on the lower boom 6 by fastening it to a saddle bracket (136 FIG. 4) and securing it to the lower boom 6 with a "U" bolt (138 FIG. 4). Two nut-and-bolt assemblies 140*a* and 140*b* respectively, were installed on the insulating plate 134. A flexible insulating line 142 was fastened to the top apex of parasitic element 10 and fastened to a separate insulating plate 146 through a bore 147 near the top of insulating plate 146. Two nut-and-bolt assemblies 140*c* and 140*d* respectively were installed on the insulating plate 146. The ends of a length of wire 156 were fastened to nut-and-bolt assemblies 140*a* and 140*b* respectively. The ends of a separate length of wire 158 were secured to nut-and-bolt assemblies 140*c* and 140*d* respectively. One end of a length of flexible insulating line 150 was secured through a bore 151 near the top of insulating plate 134. The other end of the flexible insulating line 150 was secured through a bore 152 near the bottom of insulating plate 146. The wires 156 and 158 were secured essentially concentrically inside parasitic element 10 by means of three flexible insulating lines 164, 142, and 166. The ends of a single piece of wire 168 were secured to nut-and-bolt assemblies 140*c* and 140*d* respectively. The wire 156, in combination with wire 170 comprise parasitic element 177. The wire 158 in combination with wire 168 comprise parasitic element 179. Driven elements 124, 126, and 8 comprise composite driven element 172. Parasitic elements 177, 179, and 10 comprise composite parasitic element 181. Driven elements wire 126 and parasitic element wire 166 were made of 16 gate copperclad stranded steel wire. Driven element wire 124 and parasitic element wire 158 were made of 16 gage stranded copper wire. The various "jumper" wires used in this and other embodiments disclosed were made of solid copper wire in various gages ranging from 14 to 20 gage.

Driven element wire 76 was fastened to draw lines 106*a* and 80*a*. Parasitic element wire 104 was fastened to draw lines 106*b* and 106*c*. Draw lines 106*a*, 106*b*, and 106*c* were put in tension. Draw lines 106*a* and 80*a* were secured to eyelet 86*a*. Draw lines 106*b* and 106*c* were secured to eyelet 86*b*. The separation between composite driven element 172 and composite parasitic element 181 was approximately 5 feet 8 inches as measured along the lower boom. The end of draw line 80*b* was secured near the outboard end of lower boom 6 with all the tension on the draw line removed.

A 50 ohm coaxial transmission line 184 was connected to nut-and-bolt assemblies 68*b* and 68*c*. The ends of a single wire 178 were fastened is nut-and-bolt assembly 68*b* and 122*d* respectively. The ends of another single piece of wire 180 were fastened to nut-and-bolt assembly 68*c* and 122*c* respectively and positioned in such a way to avoid any significant electromagnetic coupling between them. One end of a quarter electrical wavelength of 70 ohm coaxial cable 102, used as an impedance transformer, was connected to nut-and-bolt assemblies 122*a* and 122*b*. The other end of coaxial cable 182 was connected directly to a 50 ohm coaxial transmission line (not shown). The insulating plates 116, 134, and 146 were made of plexiglass.

The three separate driven elements 8, 126, and 124, and the three separate parasitic elements 10, 177, and 179 were tuned by adjusting their respective lengths for optimum performance in the 20, 15, and 10 meter amateur radio bands respectively. The 20 and 10 meter antennas demonstrated a VSWR bandwidth of 2/1 or less of approximately 350 khz. or more. The 10 meter antenna, connected to a separate feedline, demonstrated a VSWR bandwidth of 2/1 or lower of more than 800 khz. The directional characteristics of all the antennas fell within the parameters as described earlier in this disclosure.

When tuned for optimum performance at this element spacing, the reflectors were approximately 5.2 per cent longer than the driven element on 20 meters, 6.2 per cent longer than the driven element on 15 meters, and 8.6 per cent longer than the driven element on 10 meters, respectively. This demonstrates a unique feature for an antenna of this type, which is that the optimum reflector length for any particular antenna increases as the spacing between the driven element and its associated parasitic reflector increases, which means that optimum performance for any particular antenna may be achieved at a variety of element spacings, the lengths of the driven element and its associated parasitic reflector being selected to achieve the desired operating parameters of the antenna at the desired spacing between the driven element and its associated parasitic reflector. It also demonstrates that multiple, substantially concentric elements may be used effectively on the antenna system, while taking advantage of the unique structural and electrical properties of the antenna system. As will be obvious to one skilled in the art, further increasing the spacing between the driven element(s) and their associated parasitic reflectors will further increase the difference in length between the driven element and that of its associated parasitic reflector, when the driven element and its associated parasitic reflector are tuned for optimum performance at that spacing. Connecting the single wire 178 between nut-and-bolt assemblies 88*b* and 122*c*, and connecting the single wire 180 between nut-and-bolt assemblies 88*c* and 122*d* necessitated lengthening the 15 meter driven element by approximately 12 inches in order to return it to the resonant frequency to which it had previously been set.

Removing coaxial cable 182 from nut-and-bolt assemblies 122*a* and 122*b*, and connecting the ends of a single piece of wire to nut-and-bolt assemblies 122*b* and 122*d* respectively, and connecting the ends of another single piece of wire to nut-and-bolt assemblies 122*a* and 122*c* respectively, thus having all three driven elements fed by the single transmission line, coaxial cable 164, resulted in a considerable reduction i VSWR bandwidth of 2/1 or lower on 10 meters, and demonstrated some loss of circuitivity on 10 meters, although all operational parameters remained within the parameters as described earlier in this disclosure. As will be obvious to one skilled in the art, various matching and coupling devices, such as a balun transformer, may be used to improve the VSWR bandwidth and directional characteristics of the antennas in this arrangement.

This antenna assembly was tested for mechanical stability and durability with respect to adverse weather conditions. The antenna assembly was subjected to winter weather conditions such as those found in the northeastern United States, including repeated instances of high winds combined with heavy snow and ice loading. The antenna assembly was observed to remain quite stable and operable throughout all such weather conditions, exhibiting considerably more stability and durability then other antennas of its type. Close examination showed no noticeable dammage to tha antenna assembly had occurred as a result of the exposure. The departure from symmetry of the various antenna elements caused by these conditions had no appreciable effect on the operation of the antenna, nor did the variations in symmetry introduced during tuning and testing of the various embodiments described in this disclosure.

Since using a single transmission line for each band showed improved VSWH bandwidths for the bands used, the antenna system was then tasted using three separate transmission lines, one connected to each of the three antennas being tested, to determine the full capabilities of this embodiment.

Single wires 178 and 100 were removed from the antenna, and a separate 50 ohm coaxial transmission line was connected to nut-and-bolt assemblies 122*c* and 122*d,* there being now a separate transmission line connected to each of the three driven antenna elements on the antenna assembly. Elements were retuned for optimal performance. This yielded a considerably wider VSWR bandwidth of 2/1 or lower an 15 meters, and increased the optimum parasitic reflector length to approximately 7.0 per cent longer than that of the 15 meter driven element, and the optimum parasitic reflector length of the 10 meter parasitic reflector to approximately 9.1 per cent longer than that of the 10 meter driven element. No significant changes in directional charactistics of the antennas were noted, when compared with the embodiment listed above which used two separate transmission lines to feed the three driven elements.

By utilizing draw line 106*a* in combination withdraw line 80*a,* and draw line 106*b* in combination with draw line 106*c,* the antenna elements were than spaced at approximately 7 feet 10 inches, and subsequently at approximately 8 feet. The lengths of the driven and parasitic elements were left intentionally the same. The VSWR bandwidth of 2/1 or lower on 20 meters improved substantially, and the VSWR bandwidths of 2/1 or lower on 15 and 10 meters respectively remained approximately the same. Again, the directional characteristics of the antenna remained within the previously defined parameters, further demonstrating the wide effective range of variance from optimum reflector length.

Due to the unique operational properties of the embodiments of the antennas tested, it was not clear whether an additional antenna, or antennas, could be installed on the structure between the driven and parasitic elements depicted in FIG. 1, without causing significant interactive deterioration in the performance of one or more antennas installed on the structure. It was also not clear if mounting the lower horizontal portions of the internally mounted antenna elements in the same plane described by the lower horizontal portions of the antenna elements depicted in FIG. 1 would contribute to any deterioration in performance, as full-wave antennas of this type which utilize separate antennas for different frequency bands mounted on the same structure at different spacings either have the loop elements arranged so that the centroids of the various loop elements of different sizes lie approximately in a straight line, having the lower horizontal portions of the elements for different frequency bands at different elevations, (as in the "cubical quad", e.g.), or the upper horizontal portions of the elements for different frequency bands lie at different elevations, (as in the "delta" quad, e.g.).

It was also deemed necessary to test the assembly for the additional weight and wind loads introduced by the additional antenna elements.

Figure 5:
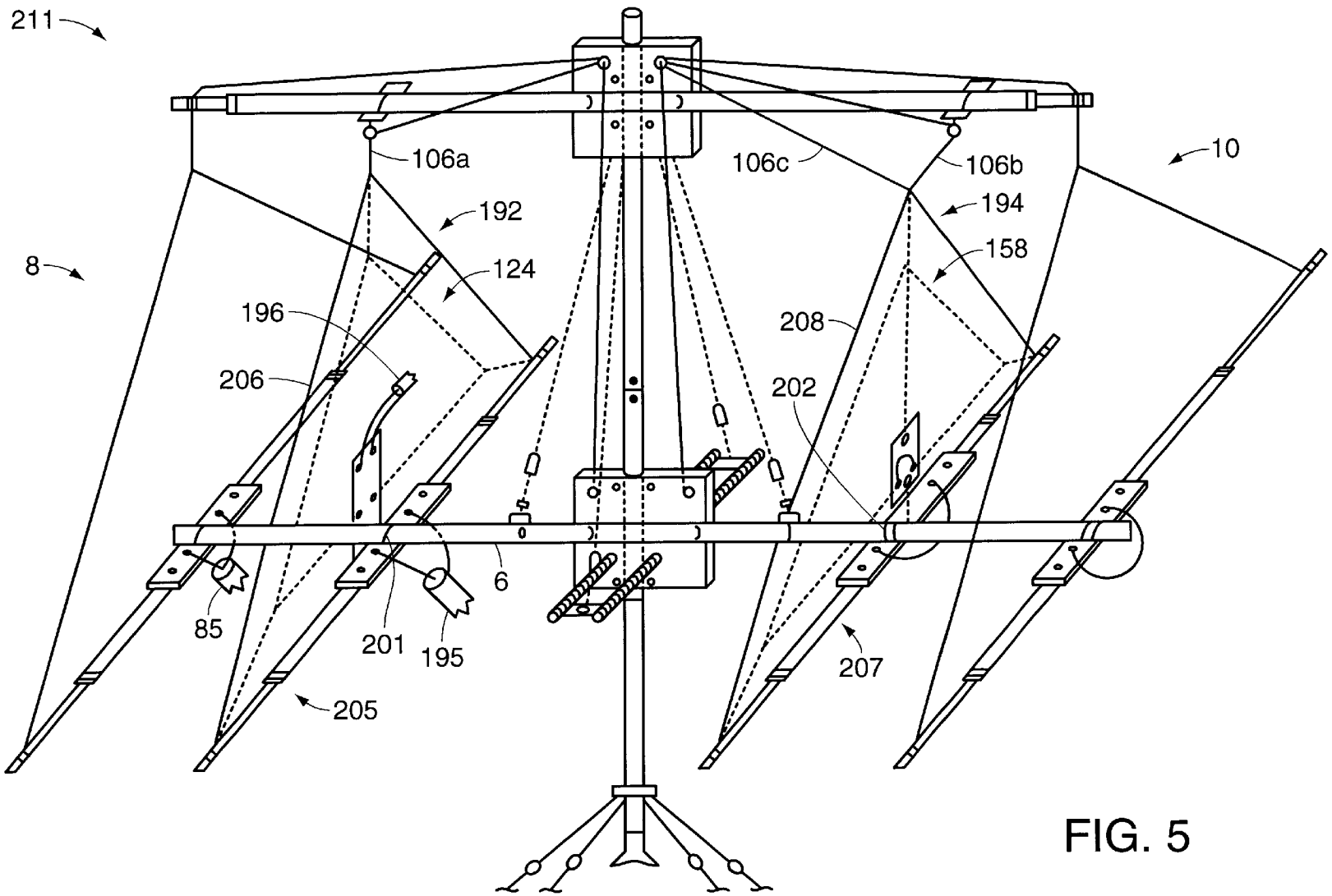
FIG. 5 is a perspective view of an antenna assembly designed for use on three separate frequency bands, with the driven and parasitic elements for one band spaced wider apart than the driven and parasitic elements for the other two bands.

To examine these questions, an embodiment of the antenna system 211, as depicted in FIG. 5 was constructed and tested. The 20 meter elements 8 and 10 respectively were returned to the spacings and positions, and their lengths adjusted as depicted in the embodiment shown in FIG. 1. A 15 meter driven element 192, comprising element member 205 and wire 206, and a parasitic element 194, comprising element member 207 and wire 208, were constructed in approximately the same fashion, and is approximately the same geometric proportions as the driven element 8 and the parasitic element 10 depicted in connection with the embodiment which was shown in FIG. 1, and installed on the lower boom 6, using draw lines 106*a,* and 108*b* and 106*c* in combination, to space the elements approximately 5 feet 9 inches apart, the 15 meter parasitic element being secured to the lower boom 6 with a single "U" bolt 202 and saddle bracket (not shown). The 15 meter driven element 192 was secured to the lower boom 6 with a single "U" bolt 201 and saddle bracket (not shown), and was fad directly with a 50 ohm coaxial transmission line 195. To further test the domain of effective parasitic frequency deviation from the optimum, the length of the parasitic element (reflector) 194 was set at approximately 8 per cent longer then the length of the driven element 192.

The VSWR bandwidth of 2/1 or lower was projected (extrapolated) to be more than 800 khz. on 15 meters, and the VSWR bandwidth of the 20 meter antenna of 2/1 or lower remained approximately as described in connection with the embodiment depicted in FIG. 1, as did its directional characteristics. The 15 meter antenna supplied similar directional characteristics to the 20 meter antenna, well within the parameters as described in the connection with the other embodiments disclosed in this application. There was no noticable interactive interference detracting from the performance of the 20 meter antenna caused by the introduction of the 15 meter antenna to the system. No difficulties were observed as a result of the additional weight and wind loads introduced by the driven element 192 and the parasitic element 194.

As a further test, the 10 meter driven element 124 and the 10 meter parasitic element 158, both shown in phantom, which were described in connection with the embodiment depicted in FIG. 2, were suspended, essentially concentrically, inside the 15 meter driven element 192 and the 15 meter parasitic element 194 respectively, both elements being insulated from the lower boom 6, and mounted in the same fashion as they were in connection with the embodiment described and shown in FIG. 2. A ¼ electrical wavelength of 70 ohm coaxial cable 196 was used to couple the 10 meter driven element 124 to its 50 ohm transmission line, as was described in connection with the embodiment described in FIG. 2. Although alight shifts in resonant frequency were noted on the 15 and 20 meter antennas, the VSWR bandwidth of 2/1 or lower remained substantially the same on both antennas. The VSWR bandwidth of 2/1 or lower on the 10 meter band was measured to be more than 900 khz. The directional characteristics remained within the parameters described in connection with the other embodiments disclosed.

Figure 6:
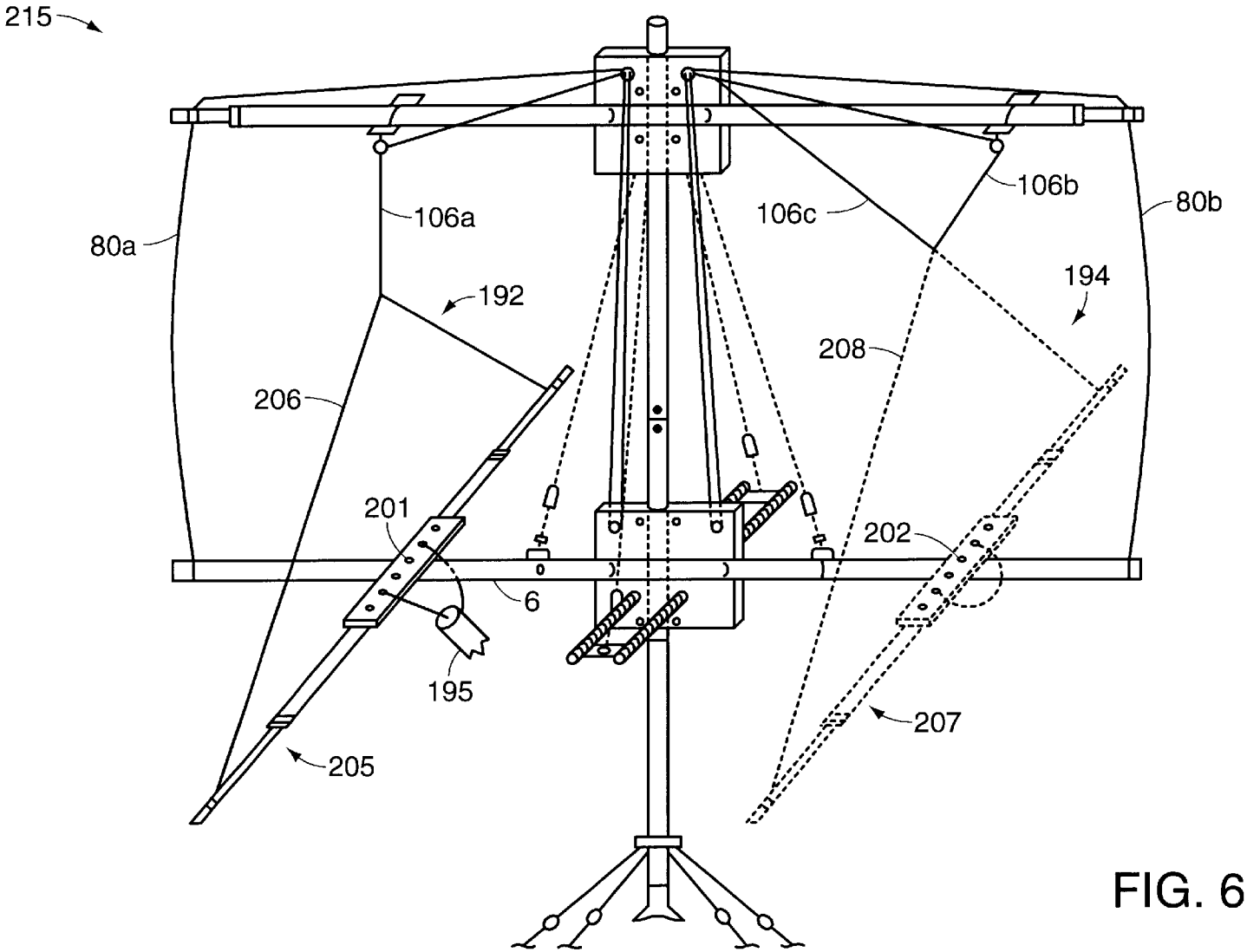
FIG. 6 is a perspective view of various combinations of antenna elements which may be used with the antenna assembly.

In the embodiment depicted in FIG. 6, 215, the 15 meter antenna as disclosed in connection with the embodiment depicted in FIG. 5 was installed alone on the structure with the same element spacing as disclosed in connection with FIG. 5, with the driven element member 205 and the parasitic element member 207 respectively installed on the upper side of the lower boom 6. The ends of the draw lines 80*a* and 80*b* respectively were secured near the ends of the lower boom 6 with all tension removed. Removing "U" bolts 201 and 202 respectively, and supplying sufficient tension to draw lines 106*a,* and 106*b* in combination with draw line 106*c* respectively, it was possible to lift the driven element 192 and the parasitic element 194 completely up off the lower boom 6. Although there was some upward bending of the element members 205 and 207 respectively, this demonstrated that the lower boom does not need to be load-bearing while maintaining the desired geometric shape of the loop elements 192 and 194 respectively. (Obviously, the degree of upward bending, or "sag" of the semi-rigid element members on this and all other embodiments disclosed is a function of the geometries of the loop elements, the materials of which they are constructed, etc.). Re-securing the driven element member 205 and the parasitic element member 207 respectively to the lower boom 6, and testing the VSWR on the antenna, it was observed that the resonant frequency of the antenna had dropped from approximately 21.300 Mhz. to approximately 21.000 Mhz., a significant shift in frequency. The VSWR at resonance was almost identical at both frequencies. This is in sharp contrast to comparisons taken with the 20 meter antenna mounted alone, and with the 15 meter antenna mounted on the same boom, as in FIG. 5, since on the 20 meter antenna, the resonant frequency remained approximately the same at approximately 14.2 Mhz., and the VSWR was only slightly higher when the two antennas were mounted on the structure.

This indicates, however, that although the internally mounted antenna did not interfere with the externally mounted antenna, the reverse was not the case, although, as stated above, no significant deterioration in performance was noted in the 15 meter antenna, when mounted on the same booms with the 20 meter antenna, and the 15 meter antenna did not perform noticably better when mounted alone on the structure. It may, however, be necessary to "touch up" the tuning of some antennas when other wider-spaced antennas are added to the structure.

The lengths of the driven element 192 and the parasitic element 194 (shown in phantom) were then adjusted to make the parasitic element 194 act as a full-wave loop director element, rather than a reflector. When the elements were tuned for optimum performance, the length of the parasitic director corresponded closely to approximately one full wavelength at the resonant frequency of the antenna at approximately 21.3 Mhz. The length of the driven element 192 corresponded to a frequency which was approximately 7.5 per cent lower than that of the parasitic director, or, stated conversely, the length of the parasitic director corresponded to a frequency which was approximately 7 per cent higher than that of the driven element. The VSWR bandwidth of 2/1 or lower was approximately the same as, and tests indicate that the directional charactistics corresponded quite closely to the performance of the antenna when the parasitic element 194 was tuned as a reflector, the directional pattern being reversed approximately 180 degrees.

Removing parasitic element 194 from the structure, and using driven element 192 alone on the structure, with a ¼ electrical wavelength of 70 ohm coaxial transmission line (not shown) used as an impedance matching device between the 50 ohm coaxial transmission line 195 and the driven element 192, the antenna was tested and compared with a reference half-wave dipole at approximately the same elevation. The VSWR bandwidth of 2/1 or lower was somewhat less than when the antenna was used with a parasitic element, and the minimum VSWR was somewhat higher, due to the increased feedpoint impedance of the driven element used alone. The antenna displayed slightly better directional characteristics and slightly improved gain when compared with the reference dipole.

On all embodiments disclosed, the antennas were tuned for optimum performances near the centers of the 20, 15, and 10 meter amateur radio frequency bands. In the tests run on all parasitic embodiments disclosed, a good ballance between maximum foreward gain, maximum front-to-back ratio, maximum front-to-side ratio, and minimum VSWR was achieved. As is common to parasitic antennas, changing the resonant frequency of either a driven element or its associated parasitic element, will effect the optimum tuning of the other element with which it is operating. Also, when concentric elements were added to existing elements, both driven and parasitic, a certain ammount of interaction occurred, necessitating re-adjustment of the various element lengths to re-establish optimum tuning.

The stated correlations between parasitic element lengths and their resonant frequencies were based on the standard formula, velocity equals frequency times wavelength, and comparative length measurements of each parasitic element and its associated driven element. Some variations in this correlation may have occurred due to variations in geometric shape and the presence of other antenna elements installed on the structure. The term "a ¼ electrical wavelength of 70 ohm coaxial cable" refers to an impedance matching section which was approximately ¼ electrical wavelengths long at the desired (center) operating frequency of the antenna being tested. The abbreviations khz., and Mhz. refer to kilohertz and Megahertz respectively.

As will be obvious to one skilled in the art, the unique operational parameters disclosed need not be confined to any particular frequency, or band of frequencies. When used on frequencies in the upper regions of the Very high frequency portion of the electromagnetic spectrum, (above 150 Mhz., e.g.) and frequencies in the Ultra high frequency portion of the electromagnetic spectrum and above, certain considerations may need to be given to the physical properties of the antenna elements, such as the element diameter/element length ratio, the resistance of the conductive members comprising the elements, etc., as well as the usual types of feeding, coupling, and matching techniques that are employed at these frequencies.

Although various materials have been listed in the embodiments disclosed, as will be obvious to one skilled in the art, other suitable materials may be substituted for any or all of the materials listed. For example, the 60–61 structural aluminum tubing used for the semi-regid element members may be replaced with standard aluminum tubing of suitable strength. The various types of wire used in the antenna elements and for the upper guy wires may be interchanged using solid or stranded wire of suitable strength and conductivity, or they may be replaced with other conductive wires, such as steel or various alloys. The bakelite insulators may be replaced with textalite, or with a metal plate using stand-off type insulators. The plexiglass plates may also be replaced with textalite or other suitable insulating materials. The nylon line may be replaced with cotton twine of suitable strength, or a variety of synthetic plastic-type insulating lines. The various hose clamps may be replaced with nut-and-bolt assemblies. The aluminum plates may be replaced with steel plates. The wooden dowels may be replaced with PVC tubing. The upper guy wires may be replaced with aluminum guy wire. The various jumper wires, used to join the lower sections of the various parasitic elements, which were made from various types of copper wire, may be made from aluminum wire. The various nut-and-bolt assemblies used in all embodiments disclosed, may be made of other electrically conductive materials, such as steel, e.g. The wire portions of the various elements could be replaced with conductive tubing, although in some instances this might detract from the flexibility and durability of the antenna assembly. Some portions of the nylon string could be replaced with semi-rigid insulating material, such as PVC.

Obviously, a single draw line could be used in place of draw lines 106*a* and 80*a,* and 106*b* and 106*c* respectively, in the embodiment described in connection with FIG. 2, with an eyelet suitably placed above the composite driven element 172 and the composite parasitic element 181 respectively, or one continuous draw line could be used to raise and lower two or more wire portions of loop elements of the types disclosed. The novel draw line arrangements disclosed may be used in many ways to allow for continuous variations in the spacings between two or more antenna elements installed on the antenna assembly. With the correct placement of eyelets on the upper load-bearing boom, the elements may be placed at, or nearly at, the ends of the booms in all embodiments disclosed, the boom lengths being adjusted to accomodate the desired spacings for the elements. Also, a "clip"-type of arrangement could be used to affix the various draw lines to their respective eyelets or bores once the elements are put into their desired geometric configurations, thus securing the various draw lines to the load-bearing upper boom 4. The junctions of the element wires with their associated semi-rigid element members do not need to be at, or nearly at, the outboard ends of the semi-rigid members to enjoy some or all of the advantages of the present invention. As has been mentioned earlier, the concentricity of the elements is not a critical factor in the operation of the embodiments disclosed. Obviously, only one eyelet is needed on metal plate 16 and metal plate 22 respectively for the various draw lines used in the system. Also, a single rod or pipe of suitable strength could be used for the strut 36.

In all embodiments disclosed, the loop elements were essentially triangular in shape, the triangles being essentially symmetrical, and contacted at approximately the centers of their respective bases. All parasitic elements disclosed were electrically closed. As will be obvious to one skilled in the art, any suitable types of equipment for transmitting or receiving electromagnetic energy, or signals, may be used with any or all of the embodiments disclosed.

In all embodiments listed, the VSWR measurements were taken with a commercially manufactured meter listed as having an accuracy of plus or minus 10 per cent of full scale.

Although the embodiments listed have utilized single element and two element parasitic antennas only, as will be obvious to one skilled in the art, the overall structural design, as well as the unique operational parameters disclosed, can be enjoyed by using additional parasitic elements, or antennas which are not of the parasitic type, such as antennas using "double-driven" elements.

In all embodiments disclosed, the heights of the triangular elements were substantially less than those that would be necessary if the triangular shapes were equilateral. (The height of an equalateral triangular-shaped full-wave loop antenna element for use on the 20 meter amateur radio band would be approximately 20 feet.) The reduction in the vertical spacing between the upper load-bearing boom and the lower boom has contributed significantly to the structural stability and durability of the antenna assembly, as well as introducing very favorable operational characteristics to the antennas. Although the current data on full-wave loop antennas of the types disclosed indicates that effective operation of the parasitic array is not possible unless the sides of the elements are of equal length, or very nearly so, the extensive tests run, and the information disclosed indicates that this is not the case, and that very significant departures from the conventional proportions recommended are not only possible, but highly advantageous. As will be obvious to one skilled in the art, the particular base-to-height ratios disclosed are intended merely as examples of the present invention, and wide variances from these ratios can be successfully employed to achieve the desired structural and operational parameters of the antenna being designed. It is also interesting to note, that the feedpoint impedances of all the antennas disclosed in the embodiments listed correspond quite closely to the theoretical, and widely accepted impedance data that is listed for full-wave loop parasitic antennas having sides of equal or nearly equal length.

The base-to-height ratio used in the embodiment disclosed ranged from approximately 2.4/1 is 3/1, which is in sharp contrast to the base-to-height ratio of an equalateral triangle, which is approximately 1.15/1. The base-to-height ratio used in the embodiment described in connection with FIG. 2 was approximately 2.7/1 for all embodiments disclosed.

This variance in the proportions of the various embodiments disclosed introduced only slight effects in the various tuning parameters of the antennas disclosed, as well as various other antennas tested. Also, an certain of the embodiments of the 20 meter antennas elements disclosed, a certain ammount of "sag" existed, or was allowed to exist, in the semi-rigid lower portions of the elements, as well as a slight ammount of "sag" in the aluminum guy wire portions of the 20 meter antenna elements, such that the triangular shapes were not "perfectly" triangular. In earlier embodiments tested, and in other of the embodiments disclosed, the bottoms of the elements were configured absent of any "sag", and the wire portions of the elements were essentially straight. This slight difference in configuration introduced no noticeable differences in the performance of the antennas tested. Also, although there had been some concern that the presence of the support structure for the booms traversing the entire height of all loop elements tested would cause some degenerative interaction to the performances of the antennas, there was no evidence that this was the case on any of the embodiments tested.

In all embodiments disclosed, each loop antenna element essentially described a single plane, all such planes being disposed in an essentially vertical orientation, and all loop antenna elements being disposed essentially orthagonally to the upper and lower booms, the booms being essentially parallel, the lower members of all loop antenna elements being disposed essentially horizontally. Small variations in these orientations and dispositions introduced during testing and adjustments caused no noticable changes in the operation of any of the embodiments disclosed.

The foregoing descriptions have been limited to specific embodiments of the invention. It will be aparant, however, that variations and modifications may be made to the invention, with the attainment of some or all of the advantages of the invention. Therefore, it is the object of the appended claims to cover all such modifications and variations as come within the true spirit and scope of the invention.

What is claimed as new and desired to be secured by Letters Patent of the United States is:

1. A loop antenna assembly for the transmission or reception of electromagnetic energy comprising:

at least one support structure;

a driven loop antenna element having an electrical length for use on at least one frequency within a selected range of frequencies having a geometric configuration installed on said at least one support structure and being coupled to a transmission line for the transmission or reception of electromagnetic energy to or from said loop antenna assembly;

an additional loop antenna element having an electrical length which is greater than approximately 5% different from said electrical length of said electrical length of said driven loop antenna element for use on the same said at least one frequency within the same said selected range of frequencies, defining a selected difference in said electrical length between said elements, and installed on the same said at least one support structure at a selected distance from said driven loop antenna element, said additional loop antenna element having a geometric configuration, the geometric configuration of at least one of said driven loop antenna element and said additional loop antenna element being non-equilateral and structured and arranged to deliver approximate maximum coincidence of approximate maximum forward gain and approximate maximum front-to-back ratio wherein a change in the difference in electrical lengths between said driven loop antenna element and said additional loop antenna element compensates for a change in said selected distance between said driven loop antenna element and said additional loop antenna element to maintain said approximate maximum coincidence of said approximate maximum forward gain and said approximate maximum front-to-back ratio, said selected difference in said electrical length between said driven loop antenna element and said additional loop antenna element being a function of said selected distance between said driven loop antenna element and said additional loop antenna element to maintain said approximate maximum coincidence of said approximate maximum forward gain and said approximate maximum front-to-back ratio, for use on said at least one frequency within said same selected range of frequencies.

2. A loop antenna assembly in accordance with claim 1 wherein the geometric configurations of both said driven loop antenna element and said additional loop antenna elements are non-equilateral in shape.

3. A loop antenna assembly in accordance with claim 1 wherein said additional loop antenna element is a parasitic loop antenna element.

4. A loop antenna assembly in accordance with claim 1 wherein said geometric configuration of at least one of said driven loop antenna element or said additional loop antenna element is significantly non-equilateral in shape.

5. A loop antenna assembly in accordance with claim 1 wherein said geometrical configurations of both said driven loop antenna element and said additional loop antenna elements are significantly non-equilateral in shape.

6. A loop antenna assembly for the transmission or reception of electromagnetic energy comprising:

at least one support structure;

a driven loop antenna element having an electrical length for use on at least one frequency within a selected range of frequencies having a geometric configuration installed on said at least one support structure and being coupled to a transmission line for the transmission or reception of electromagnetic energy to or from said loop antenna assembly;

an additional loop antenna element having an electrical length which is always greater than approximately 5% different from said electrical length of said driven loop antenna element for use on the same said at least one frequency within the same selected range of frequencies, defining a selected difference in said electrical length between said elements, and installed on the same said at least one support structure at a selected distance from said driven loop antenna element having a geometric configuration, the geometric configuration of at least one of said driven loop antenna element and said additional loop antenna element being non-equilateral and being structured and arranged to provide approximate maximum coincidence of approximate maximum forward gain and approximate maximum front-to-back ratio wherein as much s an additional approximately 5% change in said selected difference in the electrical lengths of said driven loop antenna element and the electrical length of said additional loop antenna element provides approximately the same said approximate maximum coincidence of approximate maximum forward gain and approximate maximum front-to-back ratio, while keeping the same said distance between said driven loop antenna element and said additional loop antenna element, said selected difference in said electrical length between said driven loop antenna element and said additional loop antenna element being a function of said selected distance between said driven loop antenna element and said additional loop antenna element to maintain said approximate maximum coincidence of said approximate maximum forward gain and said approximate maximum front-to-back ratio, for use on said at least one frequency within said same selected range of frequencies.

7. A loop antenna assembly in accordance with claim 6 wherein the geometric configurations of both said driven loop antenna element and said additional loop antenna elements are non-equilateral in shape.

8. A loop antenna assembly in accordance with claim 6 wherein said additional loop antenna element is a parasitic loop antenna element.

9. A loop antenna assembly in accordance with claim 6 wherein said geometric configuration of at least one of said driven loop antenna element and said additional loop antenna element is significantly non-equilateral in shape.

10. A loop antenna assembly in accordance with claim 6 wherein said geometric configurations of both said driven loop antenna element and said additional loop antenna elements are significantly non-equilateral in shape.

* * * * *

UNITED STATES PATENT AND TRADEMARK OFFICE

CERTIFICATE OF CORRECTION

PATENT NO. : 6,342,861 B1
DATED : January 29, 2002
INVENTOR(S) : Daniel A. Packard It is certified that error appears in the above-identified patent and that said Letters Patent is hereby corrected as shown below:

Column 19,
Line 1, please delete the second occurrence of “said electrical length of”.
Line 5, please delete the first occurrence of “said”, and insert -- the --.
Line 7, after “at”, please delete “a selected distance from”, and insert -- said selected difference in said electrical length between --.
Line 8, after the first occurrence of “element”, please delete the “comma”, and insert -- and --.
Line 9, after “configuration”, please delete “the”, and insert -- said --.
Line 12, after the first occurrence of “and”, please insert -- being --.
Line 15, after “the”, please insert -- selected --.
Line 15, after the second occurrence of “in”, please insert -- the --.
Line 18, please delete “distance” and insert -- difference in said electrical length --.
Line 24, please delete “length”, and insert -- lengths --.
Line 26, please delete “distance”, and insert -- difference in said electrical length --.
Line 34, please delete “the”, and insert -- said --.
Lines 40-43, please delete Claim 4 in its entirety.
Lines 44-47, please delete Claim 5 in its entirety.

Column 20,
Line 8, after “same”, please insert -- said --.
Line 9, please delete “said”, and insert -- the --.
Lines 11 and 12, after the second occurrence of “at”, please delete “a selected distance from”, and insert -- said selected difference in said electrical length between --
Line 12, after “element, please insert -- and said additional loop antenna element --.
Line 13, please delete “the”, and insert -- said --.
Line 19, please delete “s”, and insert -- as --.
Line 20, please delete “5%”, and insert -- 4% --.
Line 20, please delete “said”, and insert -- the --.
Line 21, please delete “of”, and insert -- between --.
Line 22, please delete “the electrical length of”.
Line 25, before the first occurrence of “approximate”, please insert -- said --.
Line 25, before the second occurrence of “approximate”, please insert -- said --.
Line 27, please delete “distance”, and insert -- selected difference in said electrical length --.

UNITED STATES PATENT AND TRADEMARK OFFICE

CERTIFICATE OF CORRECTION

PATENT NO. : 6,342,861 B1
DATED : January 29, 2002
INVENTOR(S) : Daniel A. Packard It is certified that error appears in the above-identified patent and that said Letters Patent is hereby corrected as shown below:

Column 20 cont'd,
Line 29, please delete "length", and insert -- lengths --.
Line 31, please delete "distance", and insert -- difference in said electrical length --.
Line 40, please delete "the", and insert -- said --.
Lines 46-49, please delete Claim 9 in its entirety.
Lines 50-53, please delete "Claim 10 in its entirety.

Signed and Sealed this

Thirteenth Day of May, 2003

JAMES E. ROGAN
*Director of the United States Patent and Trademark Office*